US006951208B2

(12) United States Patent
Milton

(10) Patent No.: US 6,951,208 B2
(45) Date of Patent: Oct. 4, 2005

(54) FUEL DELIVERY SYSTEM WITH FLOW RE-DIRECTOR FOR IMPROVED RE-PRIMING SEQUENCE

(75) Inventor: Jeffery John Milton, Lake Orion, MI (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/926,430

(22) Filed: Aug. 25, 2004

(65) Prior Publication Data

US 2005/0087178 A1 Apr. 28, 2005

Related U.S. Application Data

(60) Provisional application No. 60/513,420, filed on Oct. 22, 2003.

(51) Int. Cl.[7] ..... F02M 37/04

(52) U.S. Cl. ..... 123/509; 123/514

(58) Field of Search ..... 123/509, 514, 123/510; 137/565.22, 565.34, 572, 574, 576

(56) References Cited

U.S. PATENT DOCUMENTS

| | | | | |
|---|---|---|---|---|
| 4,860,714 A | | 8/1989 | Bucci | 123/514 |
| 5,070,849 A | | 12/1991 | Rich et al. | 123/509 |
| 5,139,000 A | | 8/1992 | Sawert | 123/514 |
| 5,218,942 A | | 6/1993 | Coha et al. | 123/514 |
| 5,330,475 A | | 7/1994 | Woodward et al. | 417/89 |
| 5,769,061 A | * | 6/1998 | Nagata et al. | 123/509 |
| 5,806,560 A | | 9/1998 | Brown et al. | 137/566 |
| 6,123,511 A | | 9/2000 | Sertier | 417/87 |
| 6,155,793 A | | 12/2000 | Tuckey et al. | 417/87 |
| 6,213,726 B1 | | 4/2001 | Tuckey | 417/199.1 |
| 6,231,318 B1 | | 5/2001 | Cotton et al. | 417/423.1 |
| 6,260,543 B1 | | 7/2001 | Chih | 123/509 |
| 6,269,800 B1 | | 8/2001 | Fischerkeller et al. | 123/514 |
| 6,425,378 B1 | * | 7/2002 | Frank | 123/514 |
| 6,457,945 B2 | | 10/2002 | Kleppner et al. | 417/84 |
| 6,478,014 B1 | | 11/2002 | Kohlhaas | 123/509 |
| 6,502,558 B1 | | 1/2003 | Brunel | 123/509 |
| 6,505,644 B2 | * | 1/2003 | Coha et al. | 137/565.22 |
| 6,513,503 B2 | | 2/2003 | Iwamoto et al. | 123/509 |
| 6,598,594 B2 | | 7/2003 | Takahashi | 123/514 |
| 6,619,272 B2 | * | 9/2003 | Jones et al. | 123/514 |
| 6,640,789 B2 | * | 11/2003 | Gabauer et al. | 123/509 |
| 2001/0055530 A1 | | 12/2001 | Eck | 417/87 |
| 2002/0112700 A1 | | 8/2002 | Iwamoto et al. | 123/509 |
| 2003/0111060 A1 | | 6/2003 | Ito et al. | 123/509 |

FOREIGN PATENT DOCUMENTS

| | | | |
|---|---|---|---|
| DE | 19856298 C1 | 2/2000 | F02M/37/12 |

OTHER PUBLICATIONS

PCT International Search Report, mailed Dec. 2, 2004.

PCT Written Opinion of the International Searching Authority.

* cited by examiner

*Primary Examiner*—Carl S. Miller

(57) ABSTRACT

A fuel delivery system 10 includes a reservoir 12 in a fuel tank 14; a fuel pump 16 in the reservoir for sending fuel at an engine; a jet pump 18 including a venturi tube 22 adjacent to a nozzle 24 to draw fuel from the tank into the reservoir; a cup 25 coupled with an end of the venturi tube for containing an amount of fuel; and a jet valve 20 permitting fuel drawn by the jet pump to enter the reservoir from the fuel tank and, preventing fuel that enters the reservoir from returning to the fuel tank. The cup traps fuel inside the jet pump so that fuel accumulates in the venturi tube and in the cup to a level above the nozzle thereby permitting the jet pump to draw fuel from the tank into the reservoir.

16 Claims, 3 Drawing Sheets

FUEL DELIVERY SYSTEM WITH FLOW RE-DIRECTOR FOR IMPROVED RE-PRIMING SEQUENCE

This application is based on U.S. Provisional Application No. 60/513,420 filed on Oct. 22, 2003 and claims the benefit thereof for priority purposes.

FIELD OF THE INVENTION

This invention relates to in-tank vehicle fuel pump sending units and, more particularly, to means for ensuring that sufficient fuel is present to re-prime an engine.

BACKGROUND OF THE INVENTION

In a typical vehicle fuel supply system, when a vehicle fuel tank runs out of fuel, a small amount of fuel remains in a reservoir provided in the fuel tank. A valve keeps fuel inside the reservoir from leaking back into the tank and allows fuel to enter the reservoir when the system has not been primed previously. A conventional jet pump, operated by a fuel pump in the reservoir, draws fuel into the reservoir.

With this fuel supply system, there are times when the reservoir does not contain a sufficient amount of fuel to be delivered to and prime the engine. Thus, there is a need for an improved fuel supply system that ensures that an engine can be primed in low fuel conditions.

SUMMARY OF THE INVENTION

An object of the invention is to fulfill the need referred to above. In accordance with the principles of the present invention, this objective is achieved by providing a fuel delivery system for delivery fuel to a vehicle engine. The system includes a reservoir constructed and arranged to be mounted within a fuel tank of a vehicle and to contain fuel. The reservoir has an inlet permitting fuel from the fuel tank to enter the reservoir. A fuel pump is disposed within the reservoir and is constructed and arranged to send fuel from the reservoir to the vehicle engine. A jet pump is operated by the fuel pump and includes a venturi tube adjacent to a nozzle to draw fuel from the fuel tank into the reservoir. A cup is coupled with an end of the venturi tube and is constructed and arranged to contain an amount of fuel. The cup has an upwardly facing opening. A jet valve is associated with the jet pump. The jet valve permits fuel drawn by the jet pump to enter the reservoir from the fuel tank and prevents fuel that enters the reservoir from returning to the fuel tank. During a re-priming sequence of the engine, wherein an amount of fuel is left in the reservoir and fuel is added to the fuel tank in an amount enough to enter the inlet of the reservoir, and when the fuel pump is activated but there is not enough fuel in the reservoir to prime the engine, the cup is constructed and arranged to trap fuel inside the jet pump so that fuel accumulates in the venturi tube and in the cup to a level above the nozzle thereby permitting the jet pump to draw fuel from the fuel tank into the reservoir.

In accordance with another aspect of the invention, a method of priming an engine of a vehicle is provided. A reservoir is provided for containing fuel. The reservoir is mounted within a fuel tank of a vehicle and has an inlet permitting fuel from the fuel tank to enter the reservoir. A fuel pump is disposed within the reservoir for sending fuel from the reservoir to an engine of the vehicle. A jet pump is operated by the fuel pump and includes a venturi tube adjacent to a nozzle to draw fuel from the fuel tank into the reservoir. A cup is coupled with an end of the venturi tube and is constructed and arranged to contain an amount of fuel. The cup has an upwardly facing opening. A jet valve is associated with the jet pump and permits fuel drawn by the jet pump to enter the reservoir from the fuel tank and prevents fuel that enters the reservoir from returning to the fuel tank. The method includes adding fuel to the fuel tank in an amount enough to enter the inlet of the reservoir; activating the fuel pump causing fuel to flow through the nozzle with the cup trapping fuel inside the jet pump so that fuel accumulates in the venturi tube and in the cup to a level above the nozzle, thereby permitting the jet pump to draw fuel from the fuel tank into the reservoir; and when the jet pump draws sufficient fuel into the reservoir, sending fuel through the fuel pump to the engine.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
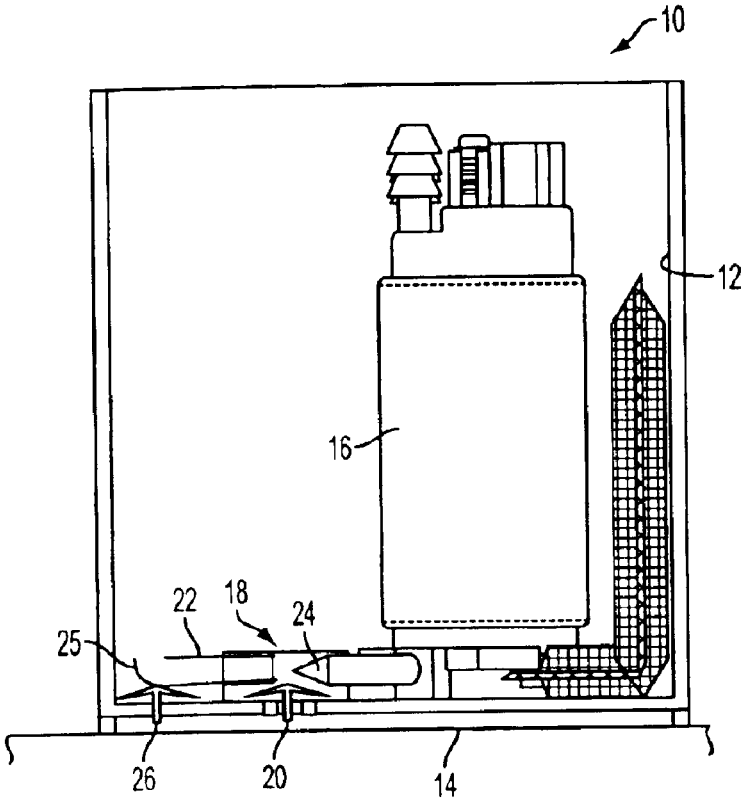
FIG. 1 is a schematic view of a fuel delivery system including a fuel pump and jet pump in a reservoir in a fuel tank, provided in accordance with the principles of the present invention.

With reference to FIG. 1, a fuel delivery system for delivering fuel to an engine of a vehicle is shown, generally indicated at 10, in accordance with the principles of the present invention. The system 10 includes a reservoir 12 that is disposed in a vehicle's fuel tank 14. A conventional fuel pump 16 is provided in the reservoir 12 for pumping fuel from the reservoir to the engine (not shown) of the vehicle. The fuel pump 16 also operates a jet pump 18 that draws fuel from the tank 14 into the reservoir 12 to ensure that the reservoir 12 is replenished with fuel. The jet pump 18 includes a venturi tube 22 associated with a nozzle 24 in the conventional manner to draw fuel though a jet valve 20 into the reservoir 12. In accordance with the invention, flow of the jet pump 18 is directed upwardly by a cup 25 coupled with the end of the venturi tube. Preferably, the cup 25 does not protrude beyond a top of jet pump 18. A first fill valve 26 is also provided in the bottom of the reservoir 12, the function of which will be explained below.

The jet pump 18 can be driven by either a) a low pressure output of the fuel pump as in the illustrated embodiment, b) a split portion of a high pressure fuel pump output, c) low pressure fuel returned from a pressure regulator or d) excess fuel returned from the engine.

Figure 2:
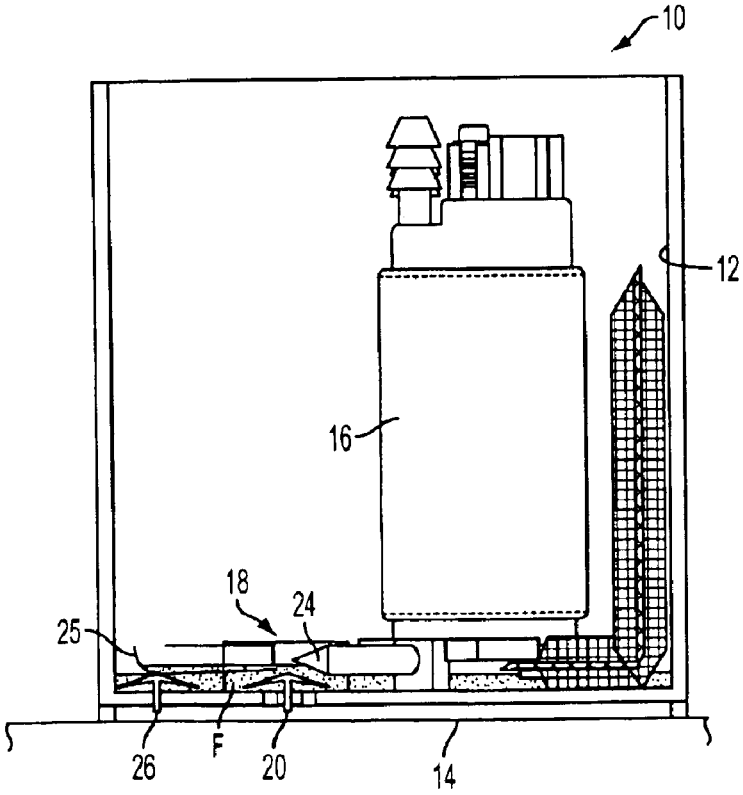
FIG. 2 is a view of the system of FIG. 1 shown in a condition when a fuel tank is out of fuel, with fuel remaining in the reservoir.

With reference to FIG. 2, when the vehicle runs out of fuel, a small amount of fuel F is left in the reservoir 12, but almost no fuel is left in the tank 14. The first fill valve 26 keeps remaining fuel F inside reservoir 12 from leaking into the tank 14, and allows fuel to enter reservoir 12 when the system has not been previously primed (i.e., new vehicle, after fuel system service, etc.). The jet valve 20 keeps a small amount of fuel inside the jet pump 18.

Figure 3:
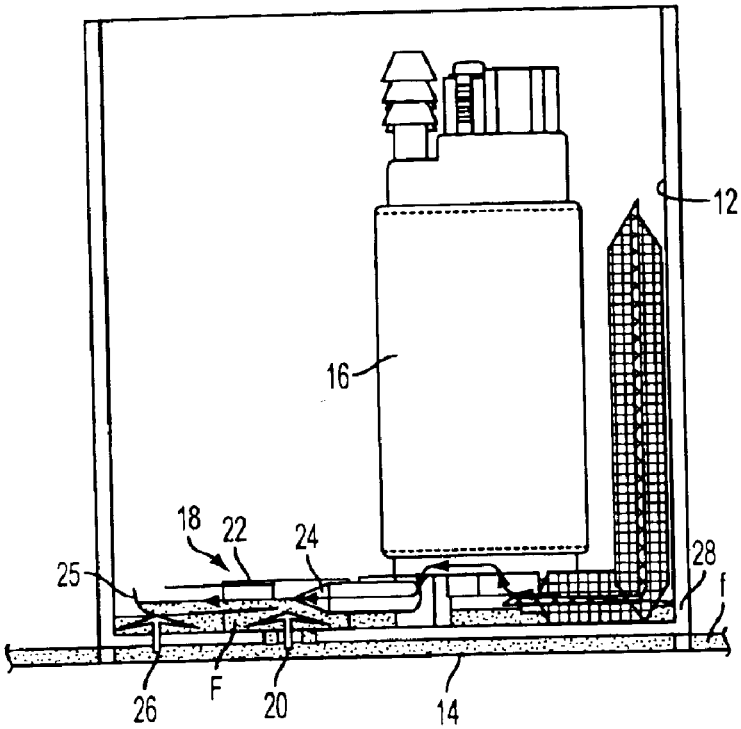
FIG. 3 is a view of the system of FIG. 1 shown in an initial pump re-priming condition.

With reference to FIG. 3, to begin the re-prime sequence, fuel f is added to the tank 14, enough to cover the inlet 28 from tank 14 into the reservoir 12. There does not need to be sufficient fuel in the tank 14 to begin flowing into the reservoir 12 on it's own. The pump 16 is turned on, and the small amount of fuel F left in the reservoir 12 begins to flow through the jet nozzle 24. There is not sufficient fuel F in the reservoir 12 to be delivered to and prime the engine. The cup traps fuel F inside the jet pump 18, accumulating fuel in the venturi tube 22 and cup 25. The jet valve 20 keeps fuel from leaking back out into the tank 12, allowing a lesser amount of fuel to be required for re-priming.

Figure 4:
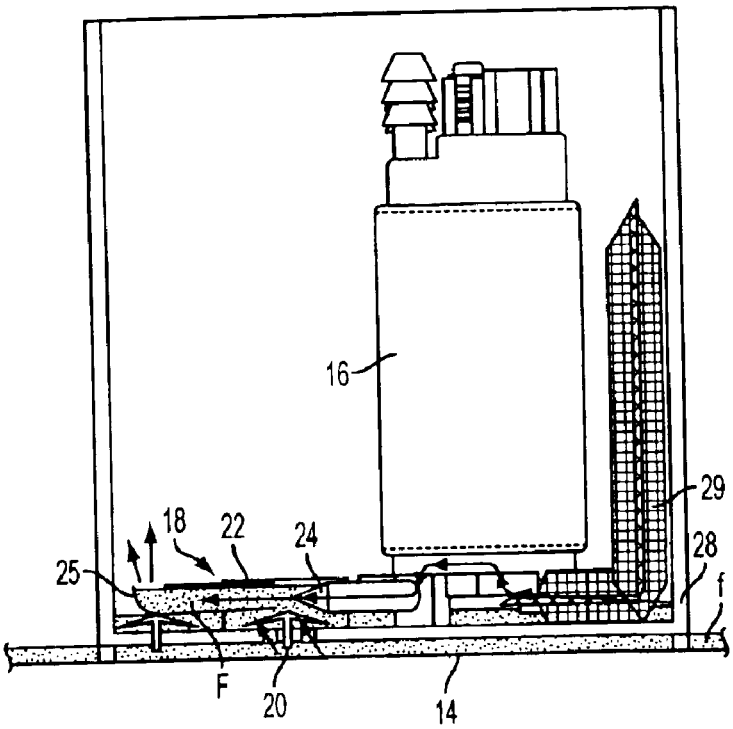
FIG. 4 is a view of the system of FIG. 1 shown in a jet priming condition.

As shown in FIG. 4, the jet pump 18 develops suction (prime) when fuel F inside the jet pump 18, venturi tube 20 and cup 25 rises to a level above the nozzle 24. When the jet pump 18 primes, it quickly begins to overflow the cup 25 and draws fuel from the tank 14 to fill the reservoir 12.

Figure 5:
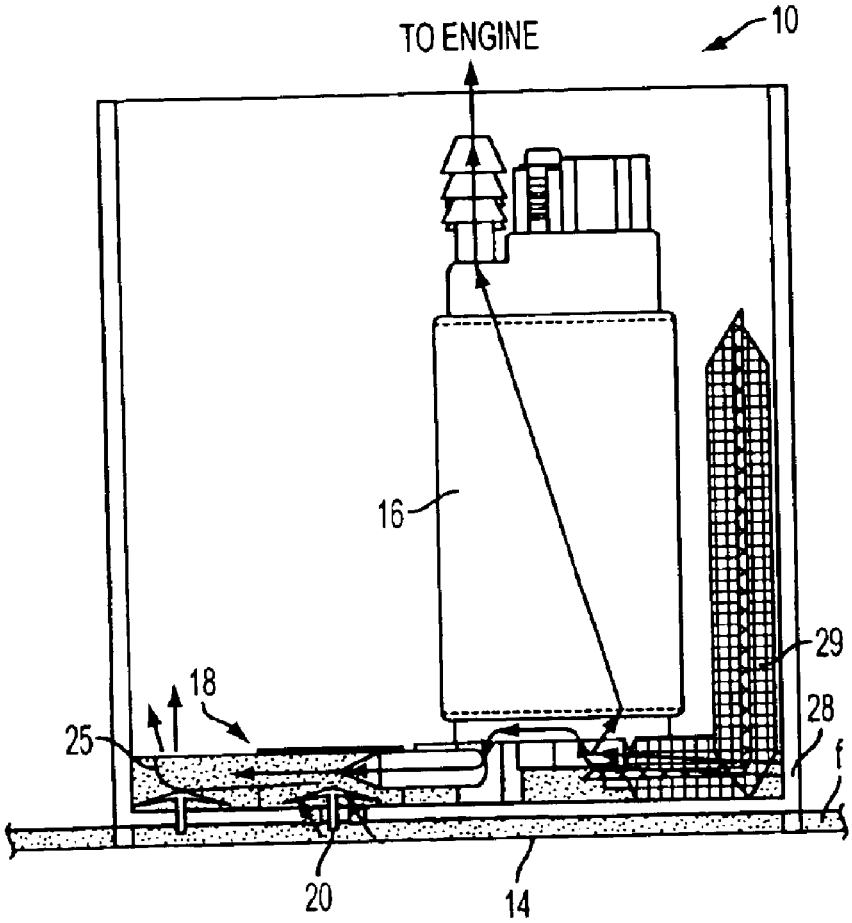
FIG. 5 is a view of the system of FIG. 1 shown with a fuel pump primed and in a fuel delivery condition.

As shown in FIG. 5, the fuel pump 16 primes and delivers fuel, filtered via filter 29, to the engine when the jet pump 18 has delivered sufficient fuel to the reservoir 12.

Figure 6:
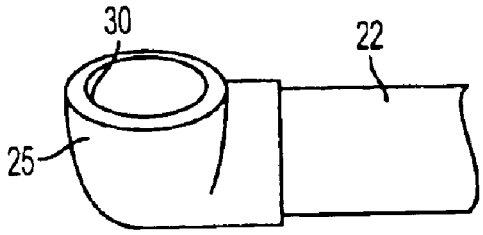
FIG. 6 is a side perspective view of an example of a cup of the invention that is coupled with a venturi tube of the jet pump.

With reference to FIG. 6, a side perspective view of an example of the cup 25 is shown. The cup 25 can be considered to be a generally a 90 degree hollow elbow-type fitting that has an upwardly facing opening 30 that fluidly communicates with the venturi tube 22. The cup 25 can include flow restrictors if desired.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel delivery system for delivery fuel to a vehicle engine, the system comprising:

a reservoir constructed and arranged to be mounted within a fuel tank of a vehicle and to contain fuel, the reservoir having an inlet permitting fuel from the fuel tank to enter the reservoir, a fuel pump disposed within the reservoir constructed and arranged to send fuel from the reservoir to the vehicle engine, a jet pump operated by the fuel pump and including a venturi tube adjacent to a nozzle, the venturi tube being completely separate from the reservoir, the jet pump being constructed and arranged to draw fuel from the fuel tank into the reservoir, a cup fluidly coupled with an end of the venturi tube, the cup being completely separate from the reservoir and constructed and arranged to contain an amount of fuel, the cup having an annular surface defining upwardly facing opening, and a jet valve associated with the jet pump, the jet valve permitting fuel drawn by the jet pump to enter the reservoir from the fuel tank and preventing fuel that enters the reservoir from returning to the fuel tank, whereby, during a re-priming sequence of the engine, wherein an amount of fuel is left in the reservoir and fuel is added to the fuel tank in an amount enough to enter the inlet of the reservoir, and when the fuel pump is activated but there is not enough fuel in the reservoir to prime the engine, the cup is constructed and arranged to trap fuel inside the jet pump so that fuel accumulates in the venturi tube and in the cup to a level above the nozzle thereby permitting the jet pump to draw fuel from the fuel tank into the reservoir.

2. The fuel delivery system of claim 1, wherein the cup is constructed and arranged such that the upwardly facing opening is below a top portion of the jet pump.

3. The fuel delivery system of claim 1, wherein the cup is defined by a generally 90 degree hollow elbow-type fitting.

4. The fuel delivery system of claim 1, wherein the cup is constructed and arranged such that during a jet pump priming condition, fuel overflows the upwardly facing opening as the jet pump draws fuel from the fuel tank filing the reservoir.

5. The fuel delivery system of claim 1, further including a fill valve permitting fuel to enter the reservoir from the fuel tank when the engine has not been primed previously and preventing fuel that enters the reservoir from returning to the fuel tank.

6. A fuel delivery system for delivery fuel to a vehicle engine, the system comprising:

a reservoir constructed and arranged to be mounted within a fuel tank of a vehicle and to contain fuel, the reservoir having an inlet permitting fuel from the fuel tank to enter the reservoir, means, disposed within the reservoir, for sending fuel from the reservoir to the vehicle engine, a jet pump operated by the means for sending, the jet pump including a venturi tube adjacent to a nozzle, the venturi tube being completely separate from the reservoir, the jet pump being constructed and arranged to draw fuel from the fuel tank into the reservoir, means, completely separate from the reservoir and coupled with an end of the venturi tube and in fluid communication with the venturi tube, for trapping an amount of fuel in the jet pump, the means for trapping having and annular surface defining an upwardly facing opening, and a jet valve associated with the jet pump, the jet valve permitting fuel drawn by the jet pump to enter the reservoir from the fuel tank and preventing fuel that enters the reservoir from returning to the fuel tank, whereby, during a re-priming sequence of the engine, wherein an amount of fuel is left in the reservoir and fuel is added to the fuel tank in an amount enough to enter the inlet of the reservoir, and when the means for sending is activated but there is not enough fuel in the reservoir to prime the engine, the means for trapping ensures that fuel accumulates in the venturi tube and in the means for trapping to a level above the nozzle thereby permitting the jet pump to draw fuel from the fuel tank into the reservoir.

7. The fuel delivery system of claim 6, wherein the means for trapping is a cup, the cup being constructed and arranged such that the upwardly facing opening is below a top portion of the jet pump.

8. The fuel delivery system of claim 6, wherein the means for trapping is a cup defined by a generally 90 degree hollow elbow-type fitting.

9. The fuel delivery system of claim 7, wherein the cup is constructed and arranged such that during a jet pump priming condition, fuel overflows the upwardly facing opening as the jet pump draws fuel from the fuel tank filing the reservoir.

10. The fuel delivery system of claim 6, further including a fill valve permitting fuel to enter the reservoir from the fuel tank when the engine has not been primed previously and preventing fuel that enters the reservoir from returning to the fuel tank.

11. A method of priming an engine of a vehicle using a fuel delivery system, the fuel delivery system comprising a reservoir for containing fuel, the reservoir being mounted within a fuel tank of a vehicle fuel, the reservoir having an inlet permitting fuel from the fuel tank to enter the reservoir; a fuel pump disposed within the reservoir for sending fuel from the reservoir to an engine of the vehicle; a jet pump operated by the fuel pump and including a venturi tube adjacent to a nozzle, the venturi tube being completely separate from the reservoir, the jet pump being constructed and arranged to draw fuel from the fuel tank into the reservoir; a cup fluidly coupled with the venturi tube, the cup being completely separate from the reservoir and constructed and arranged to contain an amount of fuel, the cup having an annular surface defining an upwardly facing opening; a jet valve associated with the jet pump and permitting fuel drawn by the jet pump to enter the reservoir from the fuel tank and preventing fuel that enters the reservoir from returning to the fuel tank; the method including adding fuel to the fuel tank in an amount enough to enter the inlet of the reservoir, activating the fuel pump causing fuel to flow through the nozzle with the cup trapping fuel inside the jet pump so that fuel accumulates in the venturi tube and in the cup to a level above the nozzle, thereby permitting the jet pump to draw fuel from the fuel tank into the reservoir, and when the jet pump draws sufficient fuel into the reservoir, sending fuel through the fuel pump to the engine.

12. The method of claim 11, wherein as the jet pump draws fuel from the fuel tank into the reservoir, fuel overflows the upwardly facing opening of the cup.

13. The method of claim 11, wherein the cup is constructed and arranged such that the upwardly facing opening is below a top portion of the jet pump.

14. The method of claim 11, wherein the cup is defined by a generally 90 degree hollow elbow-type fitting.

15. The method of claim 11, wherein a fill valve is provided that permits fuel to enter the reservoir from the fuel tank when the engine has not been primed previously and prevents fuel that enters the reservoir from returning to the fuel tank, the method including providing fuel to the fuel tank in an amount sufficient for fuel to pass through the fill valve and enter the reservoir.

16. A fuel delivery system for delivery fuel to a vehicle engine, the system comprising:

a reservoir constructed and arranged to be mounted within a fuel tank of a vehicle and to contain fuel, the reservoir having an inlet permitting fuel from the fuel tank to enter the reservoir, a fuel pump disposed within the reservoir constructed and arranged to send fuel from the reservoir to the vehicle engine, a jet pump operated by the fuel pump and including a venturi tube adjacent to a nozzle to draw fuel from the fuel tank into the reservoir, a cup fluidly coupled with an end of the venturi tube, the cup being constructed and arranged to contain an amount of fuel, the cup having an annular surface defining an upwardly facing opening, and a jet valve associated with the jet pump, the jet valve permitting fuel drawn by the jet pump to enter the reservoir from the fuel tank and preventing fuel that enters the reservoir from returning to the fuel tank, whereby, during a re-priming sequence of the engine, wherein an amount of fuel is left in the reservoir and fuel is added to the fuel tank in an amount enough to enter the inlet of the reservoir, and when the fuel pump is activated but there is not enough fuel in the reservoir to prime the engine, the cup is constructed and arranged to trap fuel inside the jet pump so that fuel accumulates in the venturi tube and in the cup to a level above the nozzle thereby permitting the jet pump to draw fuel from the fuel tank into the reservoir and during a jet pump priming condition, fuel overflows the upwardly facing opening as the jet pump draws fuel from the fuel tank filing the reservoir.

* * * * *